United States Patent [19]

Nawata

[11] Patent Number: 4,812,876

[45] Date of Patent: Mar. 14, 1989

[54] MOTOR CONTROL DEVICE FOR A COPYING MACHINE

[75] Inventor: Yoshiaki Nawata, Yokohama, Japan

[73] Assignee: Tokyo Shibaura Denki Kabushiki Kaisha, Kawasaki, Japan

[21] Appl. No.: 96,258

[22] Filed: Sep. 8, 1987

Related U.S. Application Data

[63] Continuation of Ser. No. 865,925, May 14, 1986, abandoned, which is a continuation of Ser. No. 576,422, Feb. 2, 1984, abandoned.

[30] Foreign Application Priority Data

Feb. 4, 1983 [JP] Japan ..... 58-16992

[51] Int. Cl.[4] ..... G03G 21/00

[52] U.S. Cl. ..... 355/14 R; 318/565; 355/8

[58] Field of Search ..... 355/3 R, 14 R, 14 C, 355/8; 318/39, 41, 565; 364/550

[56] References Cited

U.S. PATENT DOCUMENTS

| | | | |
|---|---|---|---|
| 3,880,516 | 4/1975 | Post et al. | 355/14 CU |
| 4,305,653 | 12/1981 | Evanitsky | 355/14 R X |
| 4,348,100 | 9/1982 | Snelling | 355/14 R |
| 4,464,044 | 8/1984 | Matsuyama | 355/14 R |
| 4,496,237 | 1/1985 | Schron | 355/14 C |

FOREIGN PATENT DOCUMENTS 2852060 6/1979 Fed. Rep. of Germany .

*Primary Examiner*—Fred L. Braun

*Attorney, Agent, or Firm*—Cushman, Darby & Cushman

[57] ABSTRACT

A motor control device for a copying apparatus which is so arranged as to individually control the motors for driving the movable components of the copying apparatus and is provided with a ten-key board designed to set a test mode and designate a motor to be tested. A test mode is set when two specific numeric keys of the ten-key board are pressed at the same time. In the test mode, the ten-key board presets a 2-digit numeral previously allotted to a motor to be tested. Determination is made from the second position of the numeral as to whether the motor to be tested should be driven or stopped.

6 Claims, 7 Drawing Sheets

MOTOR CONTROL DEVICE FOR A COPYING MACHINE

This is a continuation of application Ser. No. 865,925, filed May 14, 1986, which was abandoned upon the filing hereof, and which in turn was a continuation of application Ser. No. 576,422, filed Feb. 2, 1984, which was abandoned.

BACKGROUND OF THE INVENTION

This invention relates to a motor control device for controlling a plurality of motors used in an image-forming apparatus. Image-forming apparatus, such as copying apparatus, include discrete types whose individual units such as the document-scanning section, enlargement lens system, photoconductive drum, developer rollers and fusing rollers are independently driven by corresponding driving sources. Such discrete copying apparatus are generally provided with an AC induction motor or DC motor as the driving source. Recently pulse motors have also been applied for this purpose.

With the conventional copying apparatus, however, the respective motors can not be driven separately. When, therefore, a test is made of each motor (or each driving section), all the steps of the ordinary copying operation are performed. During this ordinary copying operation, the operating condition of the motor or its driving section has to be checked. This is an inconvenience in the maintenance of a copying apparatus.

SUMMARY OF THE INVENTION

It is accordingly the object of this invention to provide a motor control device which can individually drive a plurality of motors in a copying apparatus.

To attain the above-mentioned object, this invention provides a motor control device for a copying apparatus, the device comprising a changeover circuit for switching the operation mode to a test mode, a circuit for designating the motor to be tested and a circuit for driving the motor specified by the motor-designating circuit.

DETAILED DESCRIPTION OF THE PREFERRED EMBODIMENT

Figure 1:
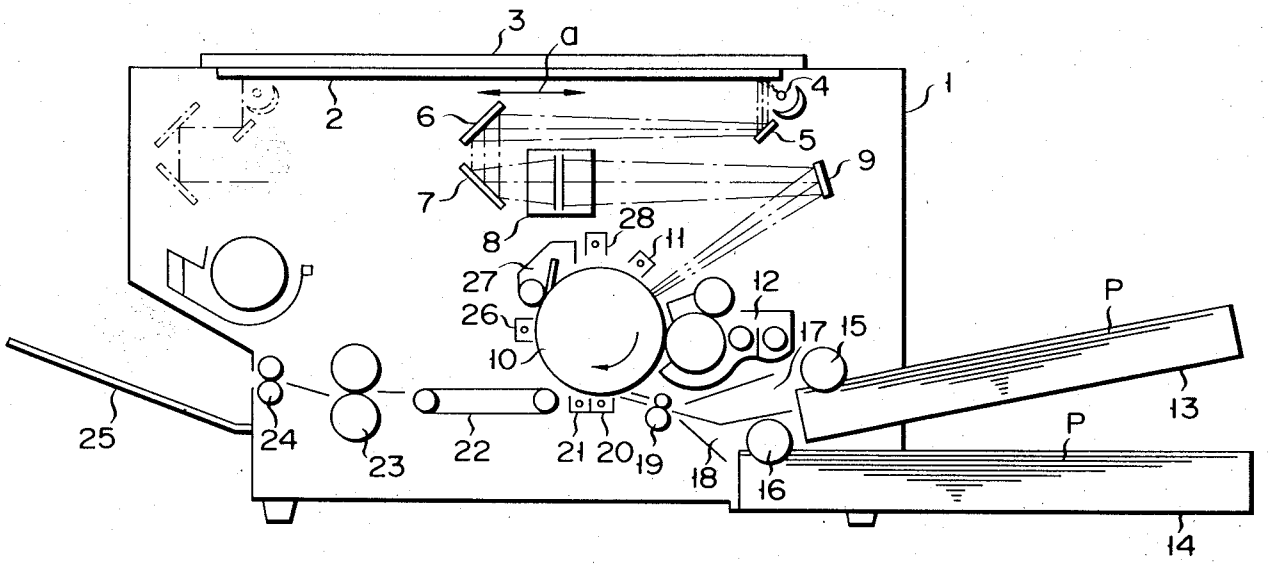
FIG. 1 schematically shows the arrangement of a copying apparatus provided with a motor control device embodying this invention.

With the copying apparatus of FIG. 1, a document table 2 is mounted on a cabinet 1. This document table 2 is made of transparent glass. A document is placed on transparent glass, and held by a document cover 3. An exposure unit is set below the document table 2. This exposure unit is provided with an optical system composed of an exposure lamp 4, and mirrors 5, 6, 7. The optical system is made to reciprocate in the directions indicated. When the optical system is moved, a document on the document table 2 is optically scanned. To maintain the prescribed length of a light path, the mirrors 6, 7 are moved at a speed half the traveling speed, of the mirror 5. The light reflected from the document is conducted to the enlargement lens system 8 by means of the mirrors 5, 6, 7. The reflected light enters a mirror 9 through the lens system 8. The mirror 9 guides the reflection to a photoconductive drum 10. This photoconductive drum 10 is rotated in the direction of an arrow C, and is electrically charged by a charger 11. When the charged photoconductive drum 10 is exposed by the exposure unit, a latent image corresponding to the pattern shown on the document is formed on the peripheral surface of the photoconductive drum 10. The latent image is developed into a toner image by a developer 12. At this time, one copy sheet after another is carried to a paper guide 17 or 18 from an upper or lower copy sheet cassette 13 or 14 by means of the corresponding paper-feeding roller 15 or 16. A register roller pair 19 delivers the copy sheet to the transfer section, where the copy sheet is tightly attached to the surface of the photoconductive drum 10. When the copy sheet passes a transfer charger 20, a toner image is transferred to the copy sheet. The copy sheet to which a toner image has been transferred is taken off the photoconductive drum 10 by a paper-peeling charger 21. The released copy sheet is sent to a fusing roller pair 23 by a conveyer belt 22. The fusing roller pair 23 fixes the toner image to the copy sheet by dissolving the toner. After leaving the fusing roller pair 23, the copy sheet is discharged to a tray 25 by a copy sheet-discharging roller pair 24.

After a toner image has been tranferred to the copy sheet, the electric charges held in the photoconductive drum 10 are discharged by an erasing charger 26. Thereafter, a toner remaining on the photoconductive drum 10 is removed by a cleaning unit 27. After the cleaning of the toner, an erasing lamp 28 projects a light on the photoconductive drum 10 to extinguish any remaining latent image.

Figure 2:
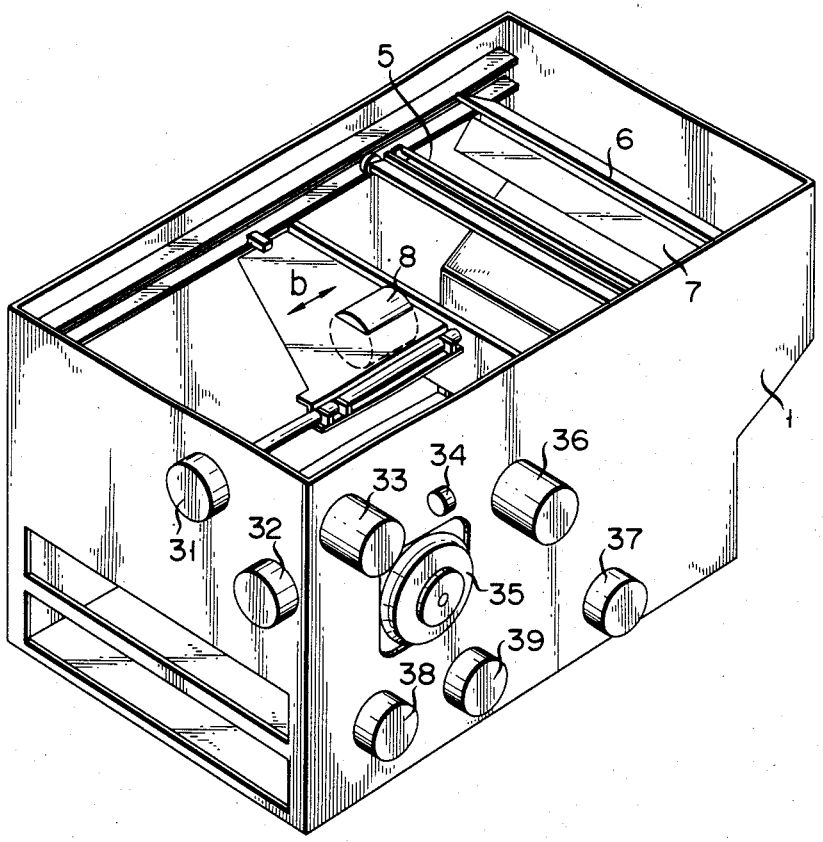
FIG. 2 is an oblique view of the internal arrangement of the copying apparatus.
Figure 3:
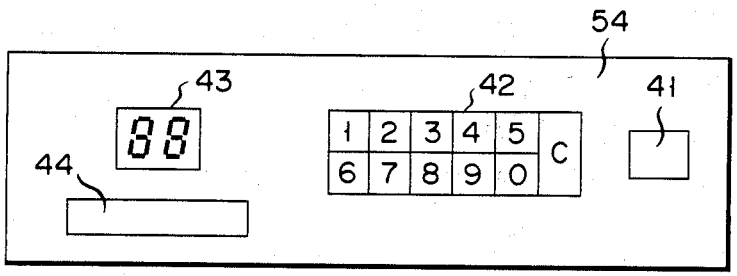
FIG. 3 is a plan view of an operation panel.
Figure 4:
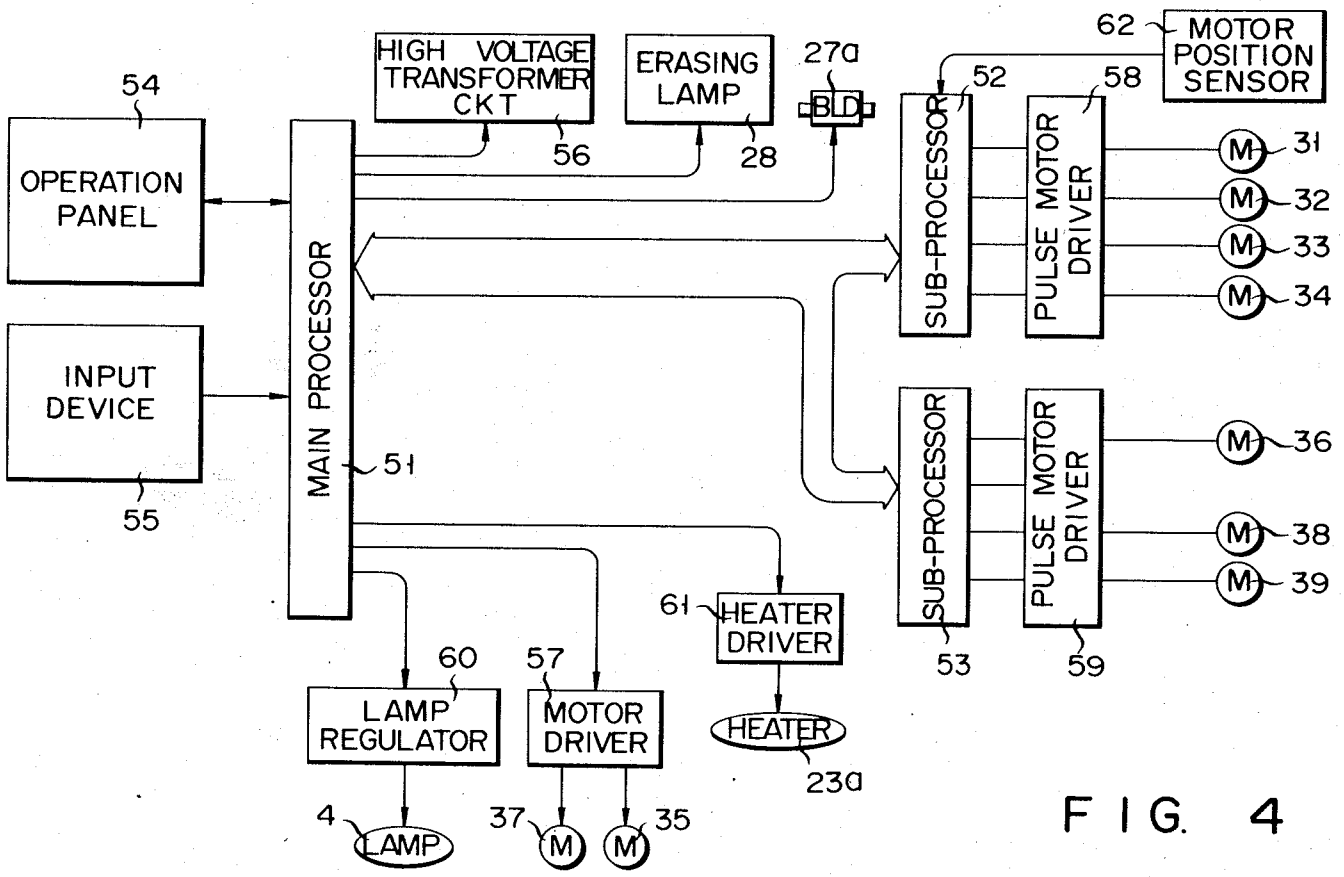
FIG. 4 is a block circuit diagram of the copying apparatus.

FIG. 2 shows a system for driving the movable components of the copying apparatus, that is, the optical system, photoconductive drum 10, etc. A motor 31 shifts the position of a lens system 8 to vary the rate at which the image of an original document is magnified or minified. A motor 32 drives the mirrors 5, 6, 7 to change the distance between the mirror 5 and the paired mirrors 6, 7 in accordance with the rate of the magnification. Reference 33 denotes a scanning motor for moving the exposure lamp 4 and mirrors 5, 6, 7 when the document is scanned. Reference numeral 34 shows a motor for driving a shutter intended to control that width of the photoconductive drum 10 facing the charger 11. Reference numeral 35 indicates a motor for driving, for example, the roller of the developer 12. Reference 36 indicates a motor for driving the photoconductive drum 10. Reference numeral 37 represents a motor for driving a conveyer belt 22, fusing roller pair 23 and paper discharging roller pair 24. Reference numeral 38 shows a motor for driving the paper-feeding rollers 15, 16. Reference numeral 39 denotes a motor for driving the register roller pair 19 for the transport of a copy sheet. The motors 31, 32, 33, 34, 36, 38, 39 are 4-phase pulse motors. The motors 35, 37 are D.C. brushless motors. Mounted on an operation panel 54 of FIG. 3 are a copy key 41, ten-key board 42, and a display unit 43 for indicating the number of copies and a display unit 44 for showing the operating condition of the copying apparatus. FIG. 4 is a block circuit diagram of the copying apparatus. According to this block circuit diagram, a main processor 51 is connected to subprocessors 52, 53 The main processor 51 is connected to an input device 55 involving, for example, the operation panel 54, and various detecting switches and sensors. The main processor 51 is also connected to a cleaning blade solenoid 27*a* of a cleaning unit 27, erasing lamp 28, high voltage transformer circuit 56, motor driver 57, lamp regulator 60 and heater driver 61. The motor driver 57 is connected to a developer motor 35 and fusing section motor 37. The lamp regulator 60 is connected to an exposure lamp 4. The heater driver 61 is connected to a heater 23*a* received in one of the paired fusing rollers 23.

The subprocessor 52 is connected to the pulse motors 31, 32, 33, 34 through a motor driver 58, and also to a motor initial position sensor 62, which is used to detect the initial rotated position of the pulse motors 31, 32, 33, 34. The subprocessor 53 is connected to the motors 36, 38, 39 through the pulse motor driver 59.

Figure 5:
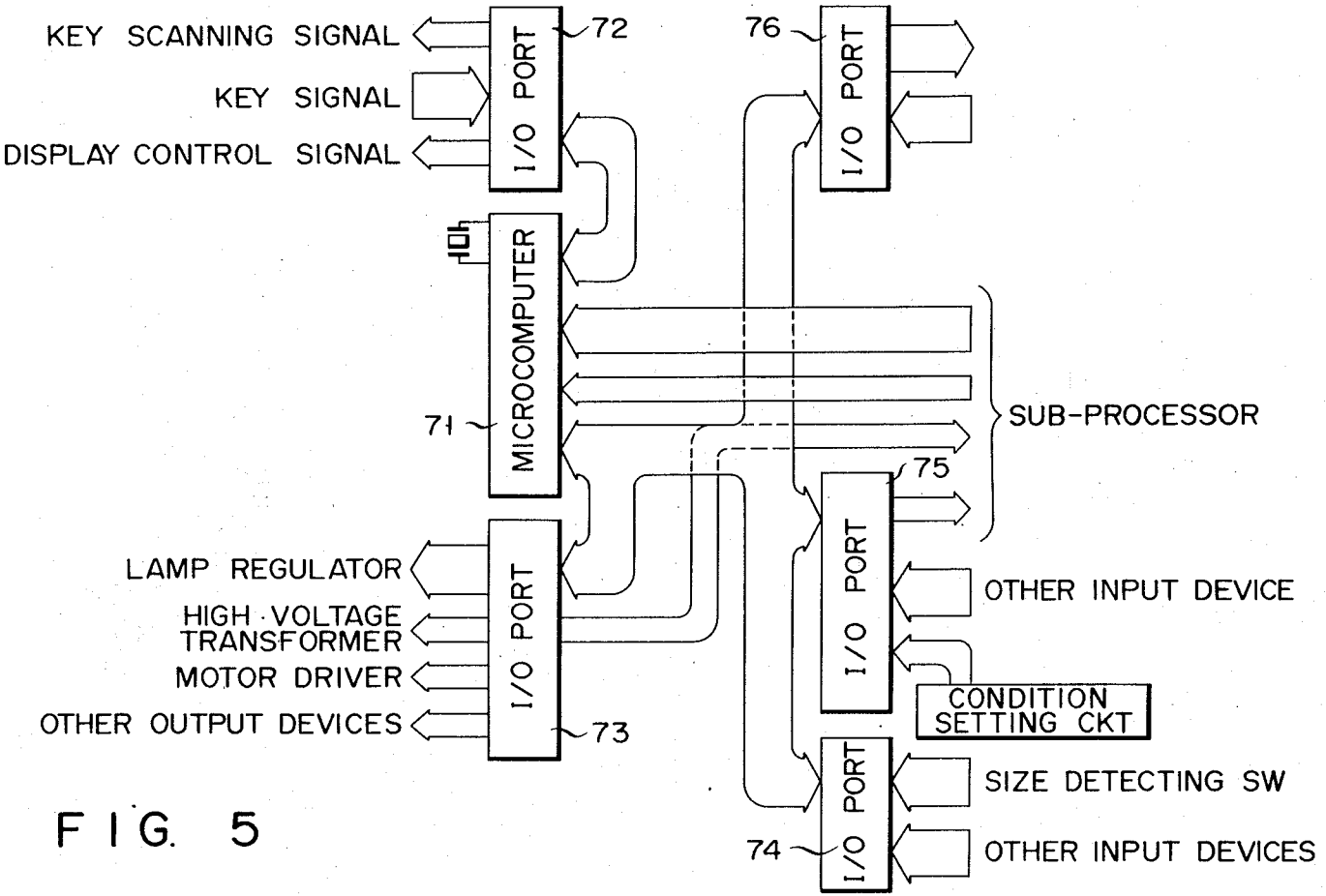
FIG. 5 is a block circuit diagram of a main processor involved in FIG. 4.

The main processor 51 comprises a microcomputer 71 and I/O ports 72, 73, 74, 75, 76 (FIG. 5). The input portion of the I/O port 72 is connected to input members such as the copy key 41 and ten-key board 42 of the operation panel 54. The output portion of the I/O port 72 is connected to output members such as display units 43, 44. The output portion of the I/O port 73 is connected to a high voltage transformer 56, motor driver 57, lamp regulator 60 and other output members. The I/O port 74 is connected to a copy-sheet-size-detecting switch and other input members. The I/O port 75 is connected to a copying conditon-presetting switch and other input members. An input-output port 76 is an optional unit.

Figure 6:
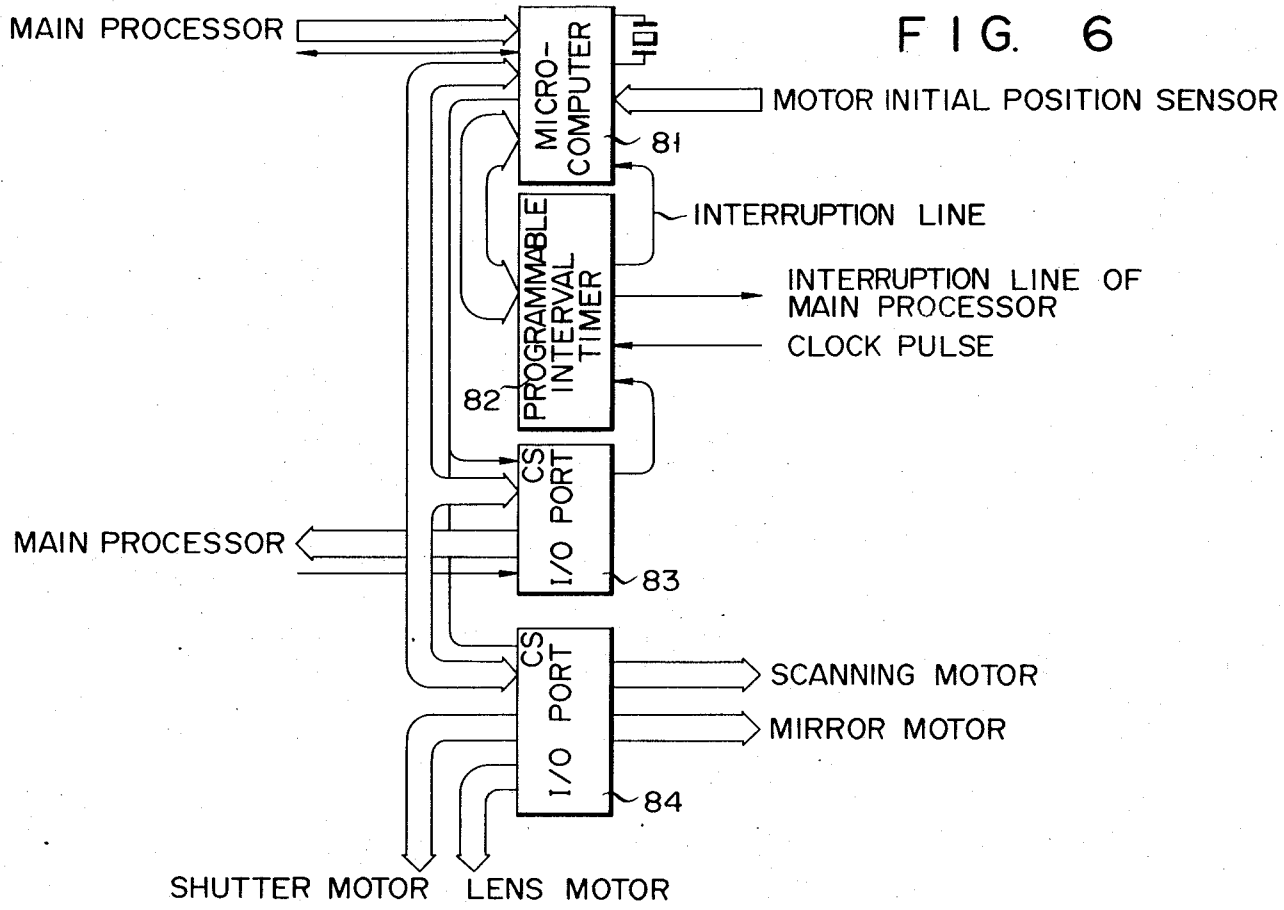
FIG. 6 is a block circuit diagram of a first subprocessor section involved in FIG. 4.
Figure 7:
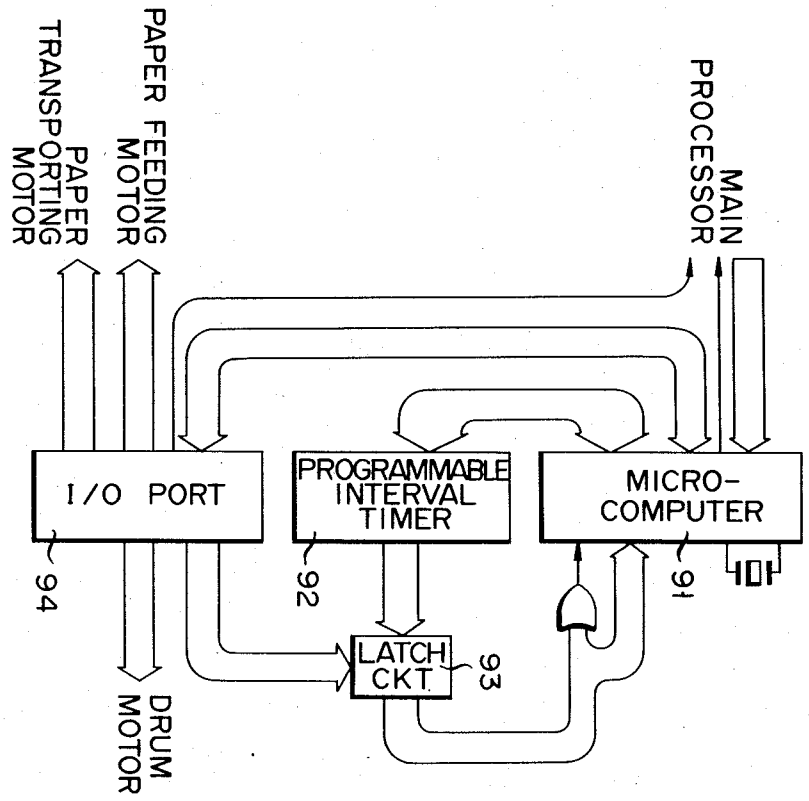
FIG. 7 is a block circuit diagram of a second subprocessor section involved in FIG. 4.

According to the arrangement of the subprocessor 52 shown in FIG. 6, a microcomputer 81 connected to the main processor 51 is also connected to a programmable interval timer 82, and I/O ports 83, 84. The programmable interval timer 82 is preset by the data previously stored in the microcomputer 81, and supplies an output pulse. The microcomputer 81 is connected to a motor position detector 62. The input-output port 83 is connected to the main processor 51. The I/O port 84 is connected to the motors 31, 32, 33, 34 through the motor driver 58.

The subprocessor 53 comprises a microprocessor 91, programmable interval timer 92, latch circuit 93 and I/O port 94. The programmable interval timer 92 and I/O port 94 are connected to a latch circuit 93. The output portion of this latch circuit 93 is connected to the input line of the microcomputer and also to an interruption line through an OR gate. An I/O port 94 is connected to the motors 36, 38, 39 through the motor driver 59.

Figure 8:
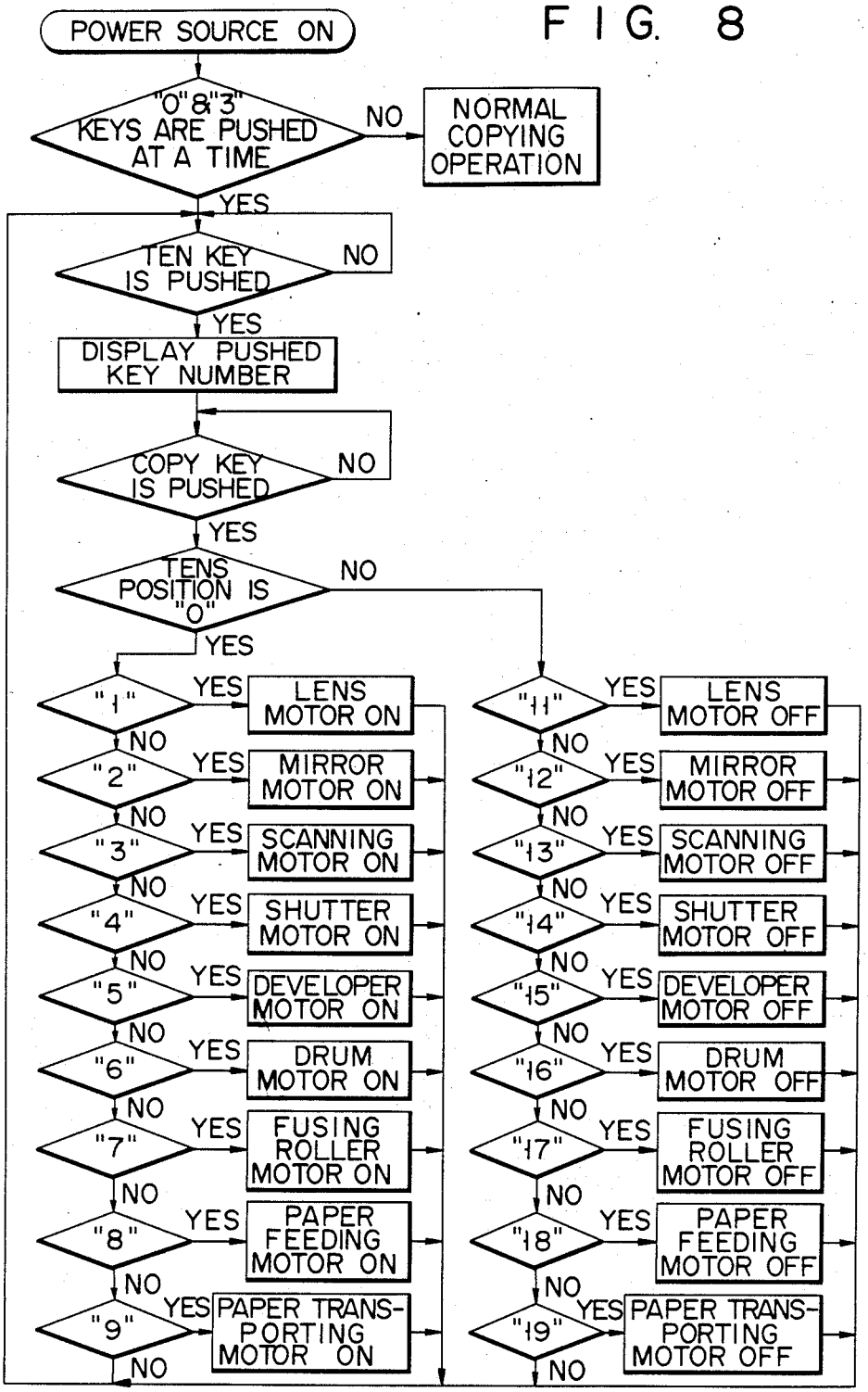
FIG. 8 is a flow chart illustrating the operation steps of the copying apparatus.

Description will now be given, with reference to the flow chart of FIG. 8, of the operation of the copying apparatus. When power is supplied, the main processor 51 is actuated to check the operation of the ten-key board 42. Namely, the main processor 51 determines whether the numeric keys "0" and "3" corresponding to the check mode code have been operated at the same time. In this case, the key signals "0" and "3" enter the microcomputer 71 through the I/O port 72. The microcomputer 71 checks the operation of the numeric keys "0" and "3". If it is found that both numeric keys "0" and "3" were not actuated at the same time, then the microcomputer 71 sets the copying apparatus at the ordinary copying mode. When it is found that the numeric keys "0" and "3" were simultaneously operated, the copying apparatus is switched to a mode for testing the motors. Thereafter, the microcomputer 71 determines whether any of the numeric keys of the keyboard 42 was depressed. When, in this condition, a code specified for any of the numeric keys is supplied from the keyboard 42, then the code is indicated on the display unit 43. Thereafter, the microcomputer 71 determines whether the copy key 41 has been operated by a key signal issued from the operation panel 54. When it is found that the copy key 41 was depressed, the microcomputer 71 checks whether the second position (digit) of numerical data received from the ten-key board 42 is represented by "0". If it is found that this is the case, then the microcomputer 71 checks whether the first place digit of the data is denoted by "1". If it is found that this is the case, the subprocessor 52 receives from the microcomputer 71 a command to actuate a lens-driving motor 31. If it is found that the first position of numerical data supplied from the ten-key board 42 denotes "2", then the microcomputer 71 supplies the subprocessor 52 with a command to drive a mirror-moving pulse motor 32. Thus the microcomputer 71 issues a command to drive any of the motors 31 to 39 in accordance with the numerical data (1 to 9) of the first position. The subprocessor 52, 53 actuate the specified pulse motor 31, 32, 33, 34, 36 or 38 by means of the pulse motor drivers 58, 59 in accordance with the contents of a drive command received from the microcomputer 71. The motor driver 57 also drives D.C. brushless motors 35, 37 in accordance with the contents of a drive command received from the microcomputer 71.

When it is found by the check of the numerical data that the second position is not "0", the microcomputer 71 determines whether the keyboard 42 has supplied a numeral "11". If it is found that this is the case, the microcomputer 71 sends a command for stopping a pulse motor corresponding to the numeral "11", for example, a lens-driving motor 31. If it is found that the numeral is not "11", the microcomputer 71 determines whether the numeral is "12". If it is found that this is the case, the microcomputer 71 issues a command to stop the mirror-driving motor 32. Thus the microcomputer 71 sends forth a command to stop a pulse motor corresponding to any of the numerals "11" to "19". The pulse motors 31 to 39 are stopped by the corresponding stop command.

Figure 9:
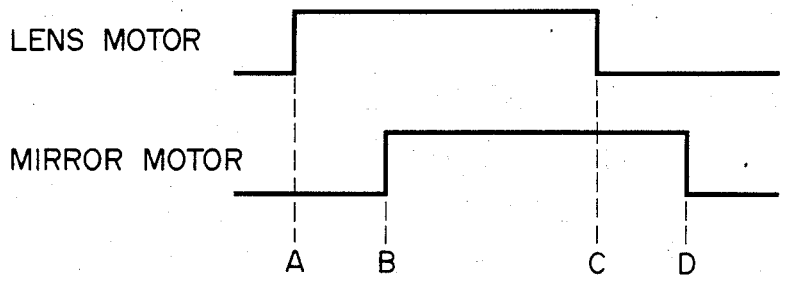
FIG. 9 is a timing chart illustrating the operation of the copying apparatus.

As described above, when a prescribed numeral is preset by the operation of any of the numeric keys, the corresponding motor is rendered conducting or non-conducting. When a numeral "1" is preset at time A as shown in the timing chart of FIG. 9, and the copy key 41 is pressed, the lens-driving motor 31 is operated. When a numeral "2" is preset at time B and the copy key 41 is pressed, the mirror-driving motor 32 is rendered conducting. When a numeral "11" is preset at time C and the copy key 41 is pressed, the lens-driving motor 31 is stopped. When a numeral "12" is preset at time D and the copy key 41 is pressed, the mirror-driving motor 32 is stopped. When two prescribed keys of the ten-key board 42 mounted on the operation panel 54 are pressed at the same time, the operation mode of the subject copying apparatus is changed to the test mode, as previously described. When the numeral of one digit corresponding to a motor to be checked is preset by operating the ten-key board 42, the specified motor is driven. When the driven motor is stopped, the numerals of two digits corresponding to the motor are preset by operating the ten-key board 42, and the copy key 41 is pressed. As mentioned above, the operation of the ten-key board 42 enables the motors to be individually rendered conducting or nonconducting, thereby ensuring the check of their current condition.

In the foregoing embodiment, the motor control device of this invention was applied to a copying apparatus. However, the device is also applicable to an electronic printer or facsimile system.

What is claimed is:

1. A motor control device for controlling a plurality of motors which are used to drive a plurality of movable components included in a copying machine and which are separately rotated, said device comprising:

key means for inputting first code information representing a motor-testing mode and second code information for designating any one of said plurality of motors to be checked, said key means including a first group of numerical keys for designating said motor to be checked and started, and a second group of numerical keys for designating said motor to be stopped; and control means for controlling said any one of said plurality of motors to be checked which corresponds to the second code information, in response to the first code information and the second code information input by said key means, said motor controlling means including means for converting each numerical data, keyed in by said first group of numeral keys, into a motor-driving command and also for converting each numerical data, keyed in by said second group of numerical keys, into a motor stopping command; and said plurality of motors being mounted on the copying machine and comprising motors for driving a lens system and mirrors in order to vary the rate at which the image of a document is to be magnified and reduced, a motor for driving an exposure lamp and mirrors, in order to scan the document, a motor for driving a developer roller, a motor for driving a photoconductive drum, a motor for driving fusing roller means, paper conveyor belt and paper-discharging roller means, and a motor for driving a paper-feeding roller.

2. The motor control device according to claim 1, wherein said air key means comprises a keyboard, having ten keys, connected to said motor-controlling means, for inputting the first and second code information.

3. The motor control device according to claim 2, wherein said motor-controlling means comprises means which recognizes the simultaneous operation of at least two keys of said ten keys as the motor testing mode.

4. A motor control device for controlling a plurality of motors which are used to drive a plurality of movable components included in a copying machine and which are separately rotated, said device comprising:

key-in means for keying in first code information representing a motor-testing mode and second code information for designating at least one of said motors to be checked, said key-in means including a first group of numeral keys for designating said motor to be check and started, and a second group of numeral keys for designating said motor to be stopped; and control means for controlling at least one of said motors which corresponds to the second code information, in response to the first code information and the second code information input by said key-in means, said motor controlling means including means for converting each numerical data, keyed in by said first group of numerical keys, into a motor-driving command and also converting each numerical data, keyed in by said second group of numerical keys, into a motor-stopping command.

5. The motor control device according to claim 4, wherein said key-in means comprises a keyboard, having ten keys, connected to said motor-controlling means for keying in the first and second code information.

6. The motor control device according to claim 5, wherein said motor-controlling means comprises means which recognizes the simultaneous operation of at least two keys of said ten keys as the motor testing mode.

* * * * *